United States Patent [19]

Fossey

[11] Patent Number: 4,882,912

[45] Date of Patent: Nov. 28, 1989

[54] TEMPERATURE CONTROLLABLE TANK CONTAINER

[75] Inventor: Robin E. Fossey, Redhills, Ireland

[73] Assignee: Container Design Limited, Monaghan, Ireland

[21] Appl. No.: 256,824

[22] Filed: Oct. 12, 1988

[30] Foreign Application Priority Data

Oct. 15, 1987 [IE] Ireland ..... 2772/87

[51] Int. Cl.[4] ..... F25D 19/00

[52] U.S. Cl. ..... 62/297; 62/239; 62/405; 62/439; 220/5 A

[58] Field of Search ..... 220/469, 5 A; 62/239, 62/297, 439, 405

[56] References Cited

U.S. PATENT DOCUMENTS

| | | | |
|---|---|---|---|
| 2,984,084 | 5/1961 | Talmey et al. | 62/297 X |
| 3,241,329 | 3/1966 | Fritch, Jr. et al. | 62/239 X |
| 3,308,630 | 3/1967 | Fritch, Jr. et al. | 62/239 X |
| 3,912,103 | 10/1975 | Gerhard | 220/5 A |
| 4,498,306 | 2/1985 | Tyree, Jr. | 62/239 X |
| 4,756,447 | 7/1988 | Gerhard | 220/5 A |

*Primary Examiner*—Lloyd L. King

*Attorney, Agent, or Firm*—Klein & Vibber

[57] ABSTRACT

A temperature controllable tank container comprises a cylindrical tank mounted between front and rear end frames. A refrigerating unit is mounted in the front end frame. An insulating shell is provided around the tank. Side ducts for carrying chilled air from the refrigerating unit are provided in similar locations on each side of the tank for chilling the tank and in turn the contents of the tank. Chilled air is returned to the refrigerating unit through top ducts also provided between the insulating shell and the tank. The side ducts and top ducts are connected by a chamber formed between an end cap of the tank and an end cap of the insulating shell.

18 Claims, 7 Drawing Sheets

TEMPERATURE CONTROLLABLE TANK CONTAINER

FIELD OF THE INVENTION

The present invention relates to a temperature controllable tank container of the type comprising a tank mounted between a pair of end frames, and an insulating shell extending round the tank and substantially enclosing the tank, longitudinally disposed, elongated ducts being provided between the insulating shell and the tank wall for carrying a heat transfer medium in one direction and for returning the heat transfer medium in the other direction along the tank, and communicating means at one end of the tank to connect the duct carrying the heat transfer medium in one direction with the duct carrying the heat transfer medium in the other direction, the ducts at the other end of the tank terminating in a respective inlet and outlet for connecting to a heating or cooling means. In particular the invention relates to a refrigerated tank container, although needless to say, it is not limited to a refrigerated tank container.

BACKGROUND TO THE INVENTION

Refrigerated tank containers are known, British patent specification No. 2,049,628 discloses a refrigerated tank container which comprises a tank mounted within a framework, the framework comprises end frames joined by longitudinal top and bottom side members. The walls of the framework are completely closed by insulating panels, which define with the tank a cavity for the circulation of a cooling medium for cooling the tank and its contents. A horizontal partition wall extending between the side and end walls of the framework and the tank forms an upper and lower chamber. An inlet and outlet is provided in one end wall to respective chambers, so that a cooling medium can flow from the inlet over the lower portion of the tank in the lower chamber and return in the upper chamber to the outlet.

Such tank containers, in general, are adapted to be connected into an external refrigerating unit or into a refrigerating system of a ship, road tanker or the like, from which the cooling medium is derived.

Such insulating tanks suffer from a considerable number of disadvantages. Firstly, the chambers for the cooling medium are of relatively large volume, and thereby require a considerable volume of cooling medium. Air is generally used as the cooling medium, and thus a refrigerating unit for cooling or chilling the air must be of a relatively large capacity to handle the volume of air required. A further disadvantage of known refrigerated tank containers is that the insulating material can be relatively easily damaged or punctured. By virtue of the fact that the insulating panels are formed in the walls of the framework, they are prone to damage as a result of being knocked against another container or other obstacle or obstruction. A further disadvantage of these known tank containers is that because of the large volume of air required, they tend to be relatively inefficient.

In alternative constructions of refrigerated tank containers, a cooling coil for carrying a liquid refrigerant is wound round the tank. In general, heat insulating material is provided around the cooling coils. These tank containers also suffer from many disadvantages. A particular disadvantage is that the coils carrying the liquid refrigerant can readily easily be damaged, thereby leading to leakage of the refrigerant. This causes the refrigerating unit to be ineffective. Furthermore, it has been found in practice that these tank containers, in general, tend to be relatively inefficient.

Similar difficulties arise in the case of tank containers where the heat transfer medium is used for heating the tank.

There is therefore a need for a tank container which overcomes the problems of known tank containers.

OBJECTS OF THE INVENTION

One object of the invention is to provide a temperature controllable tank container which provides for effective heating or cooling of the tank with a relatively small quantity of heating or cooling medium. Another object of the invention is to provide a tank container in which the insulating shell is not as prone to damage as that of tanks known heretofore. A further object of the invention is to provide a tank container in which heating or cooling of the tank is relatively efficient. A further object of the invention is to provide a temperature controllable tank container which is relatively efficient, a still further object of the invention is to provide a tank container in which a relatively inexpensive cooling medium may be used, for example air. A still further object of the invention is to provide a temperature controllable tank container which comprises an inbuilt refrigerating unit and which is not bulky or cumbersome to handle.

SUMMARY OF THE INVENTION

According to the invention, there is provided a temperature controllable tank container comprising a pair of end frames, a tank mounted between the end frames, an insulating shell extending round the tank and substantially enclosing the tank, and abutting the tank along a lower portion of the tank, two elongated side ducts for carrying a heat transfer medium in one direction along the tank being provided between the insulating shell and the tank, and disposed longitudinally relative to the tank, one of the side ducts being provided on one side of the tank and the other side duct being provided on the opposite side of the tank, the side ducts being provided in substantially similar locations on their respective sides of the tank and being separated by the portion of the insulating shell abutting the lower portion of the tank, at least one other duct extending longitudinally along the tank between the insulating shell and the tank for carrying the heat transfer medium in the other direction, communicating means at one end of the tank to communicate the side ducts with the other duct, and inlet and outlet means being provided to respective ducts at the other end of the tank for connecting the ducts to a heating or cooling means.

In one embodiment of the invention, the other duct for carrying the heat transfer medium in the other direction is provided by at least one longitudinally disposed, elongated top duct extending along the top of the tank.

In another embodiment of the invention, the side ducts are arranged so that a longitudinal centre line of each duct co-incides with a horizontal plane of the tank which extends through a longitudinal centre line of the tank.

In a further embodiment of the invention, each side duct extends over at least 10% of the outer circumference of the transverse cross section of the tank.

Preferably, each side duct is of arcuate cross section.

Advantageously, a pair of top ducts are provided, the top ducts being equi-spaced on either side of a central vertical plane of the tank, each top duct extending over at least 2% of the outer circumference of the transverse cross section of the tank.

In one embodiment of the invention, the tank is of cylindrical construction having an elongated cylindrical portion closed by end caps, the insulating shell being of partly cylindrical construction and extends around the tank and abuts portions of the tank, and a top portion of the insulating shell extends upwardly to form each top duct.

Preferably, the insulating shell comprises a heat insulating material disposed between an outer skin formed of sheet material and an inner skin formed by portion of the tank wall and plate members which form the ducts.

Advantageously, the insulating shell is closed at one end by an end cap spaced apart from the end cap of the tank to form the communicating means, the end cap being of a heat insulating material.

In a further embodiment of the invention, a cooling means provided by a refrigerating unit to cool the heat transfer medium is mounted in the end frame adjacent the inlet and outlet of the ducts, the refrigerating unit being connected to the inlet and outlet for circulation of the heat transfer medium through the side and top ducts, means to circulate the heat transfer medium being provided, so that the heat transfer medium is delivered from the refrigerating unit to the side ducts and returned to the refrigerating unit through each top duct.

ADVANTAGES OF THE INVENTION

The advantages of the tank container according to the invention are many. A particularly important advantage of the tank container is that it very effectively optimises between the amount of heat transferred to or from the tank and the size of the tank container. In other words, the tank container according to the invention can be provided as a relatively slim tank, and at the same time relatively high heat transfer to or from the tank is achieved. Furthermore, because of the arrangement of the side ducts, the quantity of heat transfer medium required is retained to a minimum, while at the same time good heat transfer characteristics are achieved. This, it will be appreciated, provides a tank container of a relatively high efficiency. Furthermore, where the tank including the insulating shell is provided internally of the outer dimensions of the end frames, the insulating shell is less prone to damage which could in many instances lead to leakage of the heat transfer medium. This, it will be appreciated, considerably improves the efficiency of the tank container. Furthermore, where the heat transfer medium is air, a further advantage is achieved in that even if the insulating shell is damaged and leaks slightly, the tank container will still effectively operate, although at a slightly reduced efficiency. However, the damage to the insulating container, in general, will not render the tank container unserviceable, which would arise in certain known constructions of tank containers.

A further advantage of the invention is the fact that because of the construction of the tank container, a relatively inexpensive tank container can be produced which is also relatively easy to manufacture.

A further advantage of the invention is achieved in cases where the other ducts are provided on the top of the tank, the insulating shell at this point is less prone to damage which could result in leaks from the top duct. In cases where the side ducts are substantially centrally aligned, a particular advantage of the invention is achieved in that the heat transfer efficiency is maximised. A further advantage of the invention is achieved when the insulating shell is of cylindrical construction and substantially follows the contours of the tank. In these cases the insulating shell, in general, falls well within the outer dimensions of the end frames and accordingly is less prone to damage, and furthermore a tank container which is relatively uncumbersome and easy to handle is provided.

These and other objects and advantages of the invention will be readily apparent from the following description of a preferred embodiment thereof, given by way of example only with reference to the accompanying drawings.

DETAILED DESCRIPTION OF THE INVENTION

Figure 2:
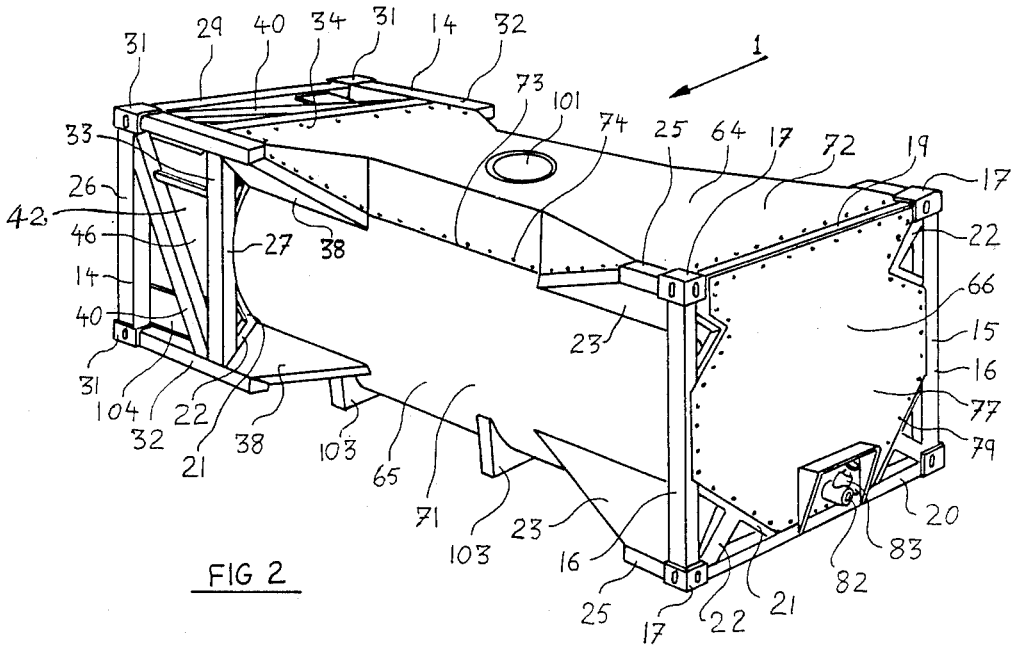
FIG. 2 is a perspective view of the tank container of FIG. 1 from a different direction.
Figure 1:
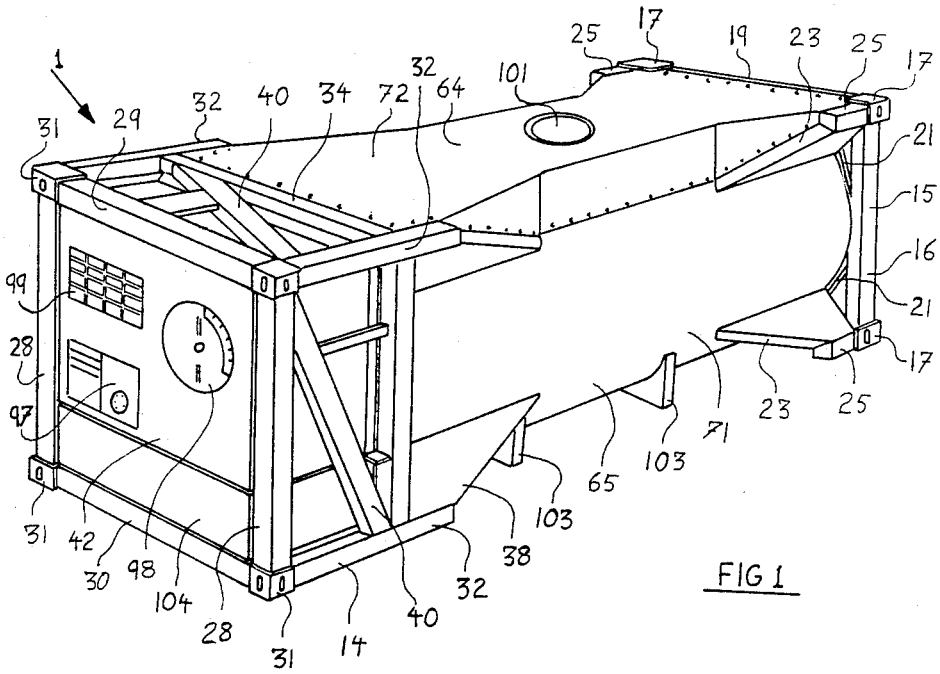
FIG. 1 is a perspective view of a tank container according to the invention.
Figure 3:
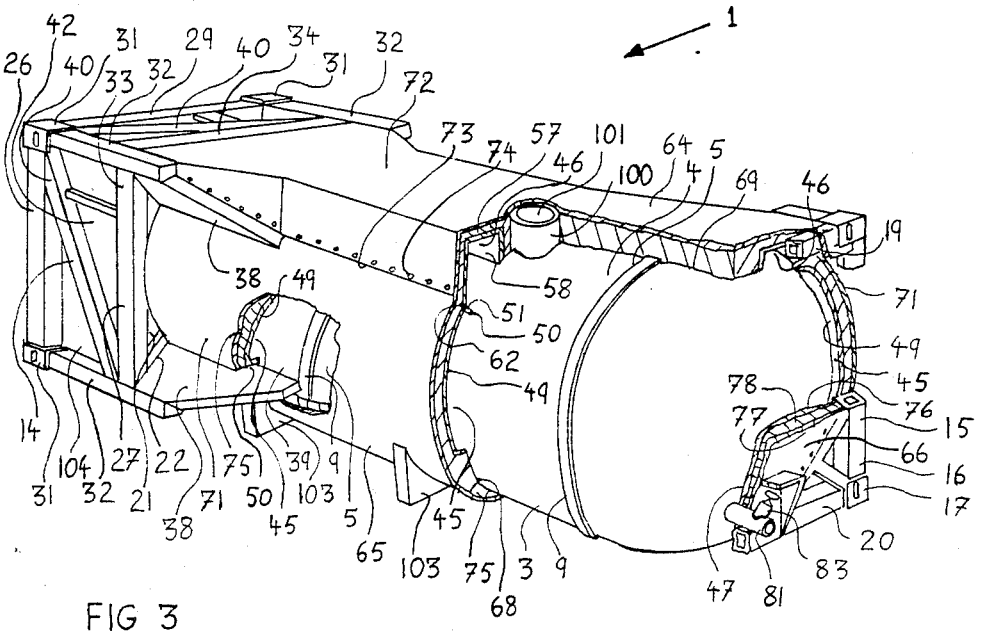
FIG. 3 is a partly cut away perspective view of the tank container of FIG. 1.
Figure 4:
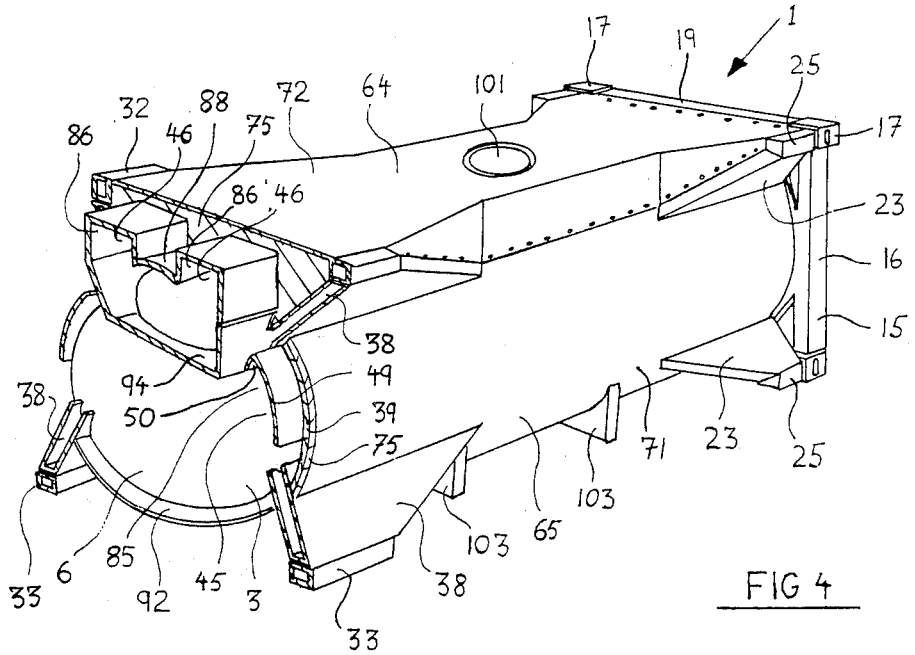
FIG. 4 is a partly cut away perspective view of the tank container of FIG. 1.
Figure 5:
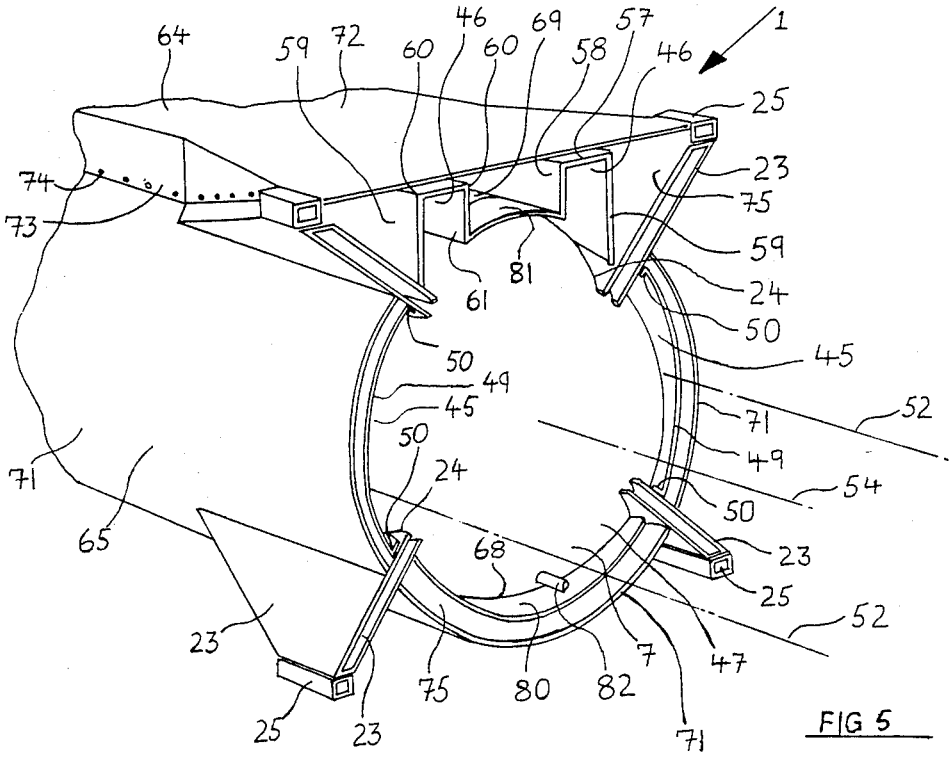
FIG. 5 is a partly cut away perspective view of portion of the tank container of FIG. 1.
Figure 11:
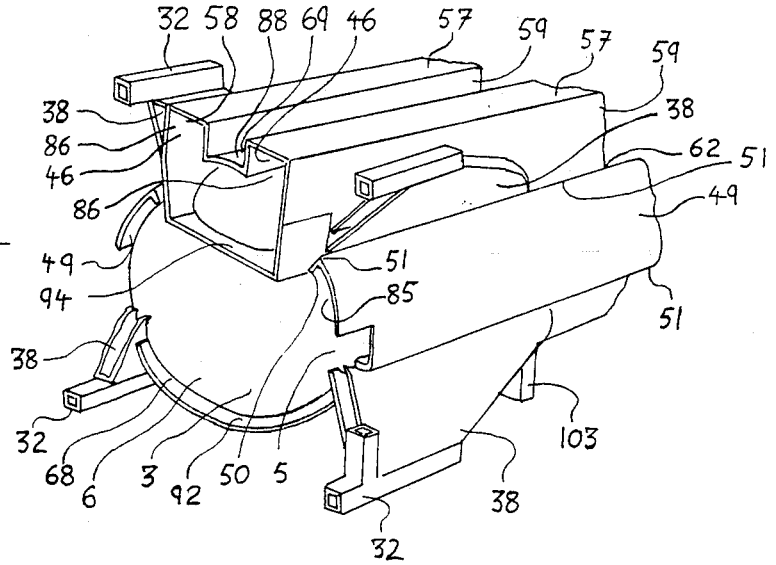
FIG. 11 is another perspective view of portion of the tank of FIG. 1 under construction.

Referring to the drawings, there is provided a temperature controllable tank container according to the invention, in this case a refrigerated tank container indicated generally by the reference numeral 1. The tank container 1 comprises a tank 3 of stainless steel material for containing bulk material, in this case liquids to be kept in a refrigerated condition. The tank 3 is of cylindrical construction, having a cylindrical portion 4 formed by a cylindrical wall 5. Convex dished end caps 6 and 7 close the cylindrical portion 4. Three stiffening hoops 9 also of stainless steel material extend circumferentially around the tank 3. One hoop 9 is provided centrally between the ends of the tank, while the other two hoops are provided towards the end caps 6 and 7. The tank 3 is mounted between a pair of end frames, namely a front end frame 14 and a rear end frame 15. The end frames 14 and 15 are constructed to ISO standards.

The rear end frame 15 comprises a pair of upstanding members 16 which extend between corner castings 17 to ISO standards and are welded thereto. Top and bottom cross members 19 and 20 respectively extend between and are welded to the castings 17. Stabilising members 21 extend between the top and bottom cross members 19 and 20 and the upstanding members 16. Carrier members 22 extend from the corner castings 17 in a generally diagonal direction to the stabilising members 21. The upstanding members 16, cross members 19 and 20, stabilising members 21 and carrier members 22 are all of box section steel welded together. Four bearer members 23 extend from the carrier members 22 to the tank 3 for supporting and securing the tank 3 to the end frame 15. The bearer members 23 are formed from bent plate metal material and are welded to the carrier members 22 and to the tank 3 at 24. A reinforcing member 25 of box section extends from each corner casting 17 and is also welded to the bearer members 23.

The front end frame 14 comprises an inner framework 26 and an outer framework 27. The outer framework 27 comprises a pair of upstanding members 28 and top and bottom cross members 29 and 30 extending between and welded to corner castings 31. The upstanding members 28 and cross members 29 and 30 are all box section material and are similar to the members 16, 19 and 20 of the rear end frame 15. The castings 31 are to ISO standards and are similar to the castings 17. Four longitudinal reinforcing members 32 also of box section material are welded to and extend from the corner castings 31. The inner framework 26 comprises a pair of upstanding members 33 welded to the reinforcing members 32 and top and bottom cross members 34 and 35 also welded to the reinforcing members 32. Stabilising members 36 and carrier members 37 similar to the stabilising members 21 and carrier member 22 of the rear end frame 15 are provided in the inner framework 26. Bearer members 38 similar to the bearer members 23 extend from the carrier members 37 and reinforcing members 32 and are welded to the tank 3 at 39. Diagonal members 40 also of box section material further strengthen the front frame 14.

Figure 6:
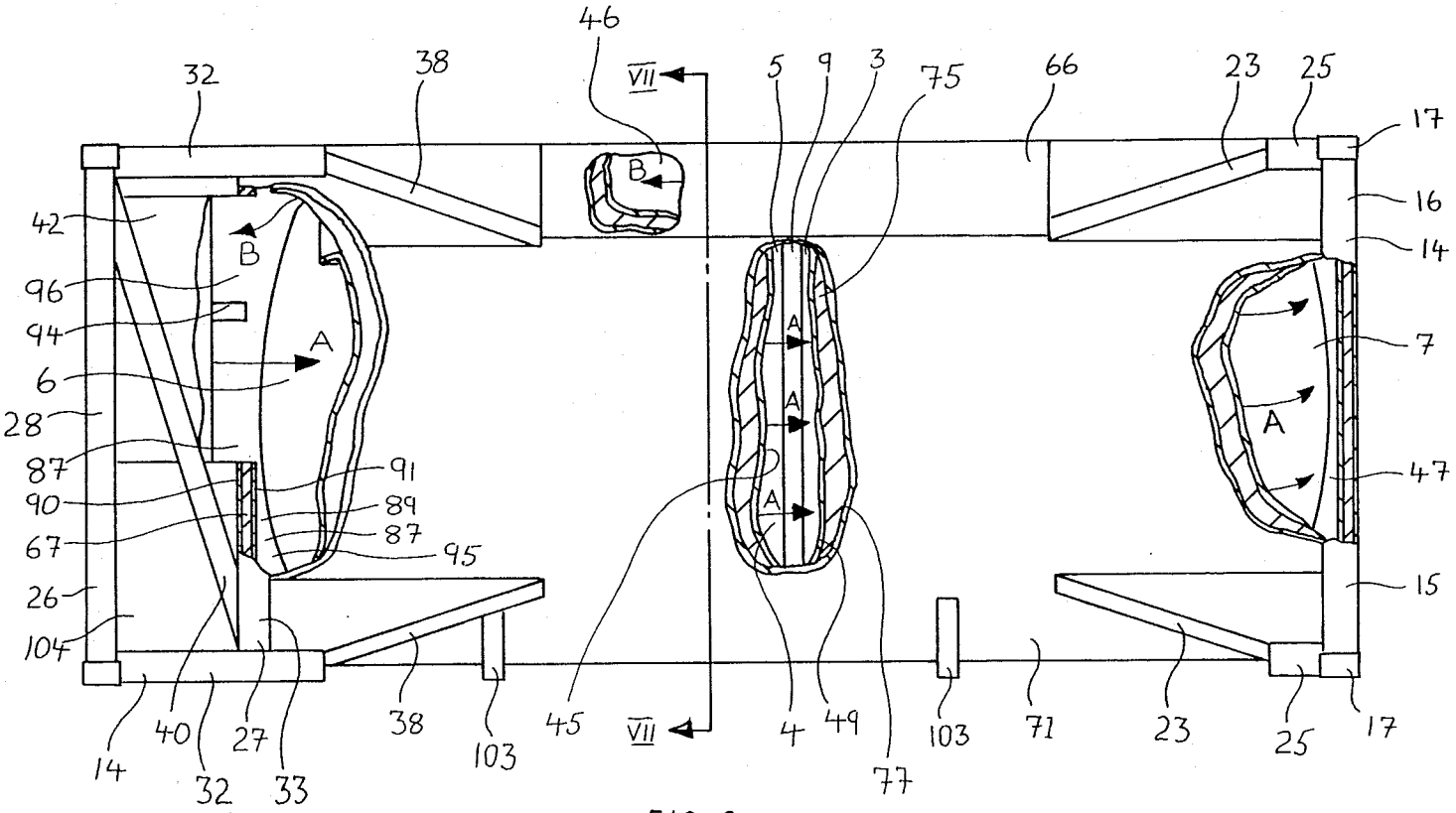
FIG. 6 is a partly cut away side elevational view of the tank container of FIG. 1.
Figure 7:
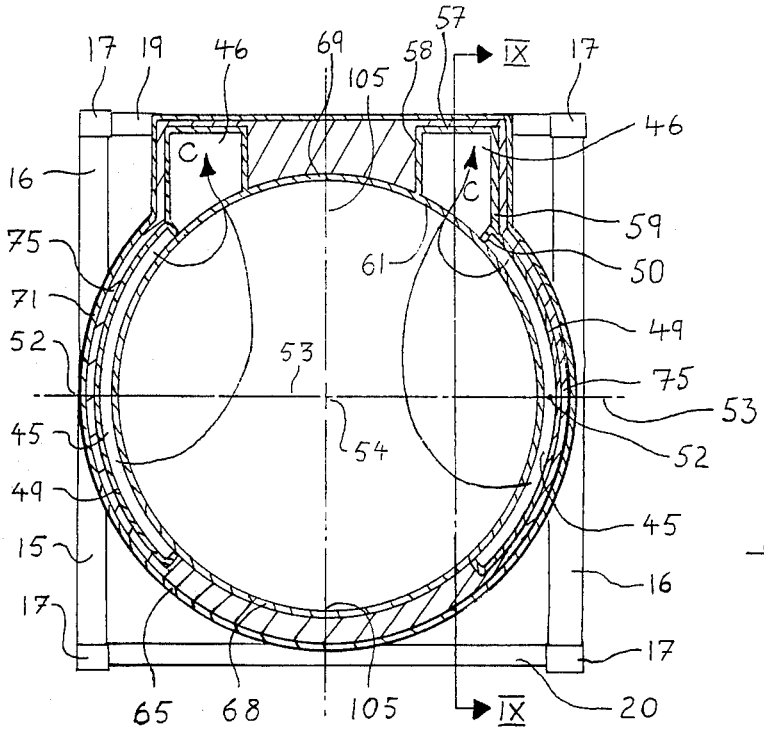
FIG. 7 is a cross sectional view of the tank container of FIG. 1 on the lines VII–VII of FIG. 6.
Figure 8:
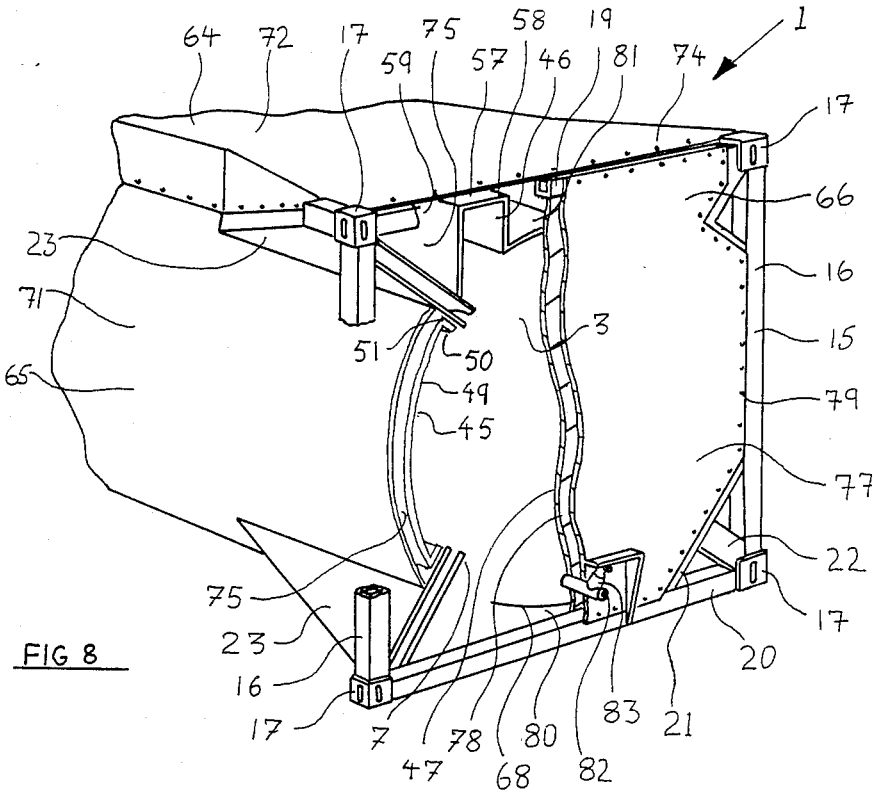
FIG. 8 is a partly cut away perspective view of portion of the tank container of FIG. 1.
Figure 10:
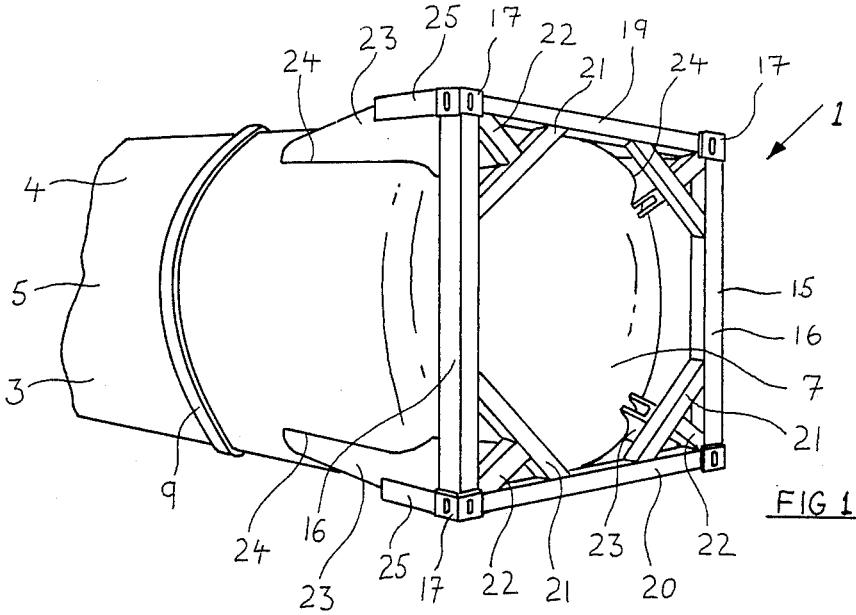
FIG. 10 is a perspective view of a detail of the tank container of FIG. 1 under construction.
Figure 9:
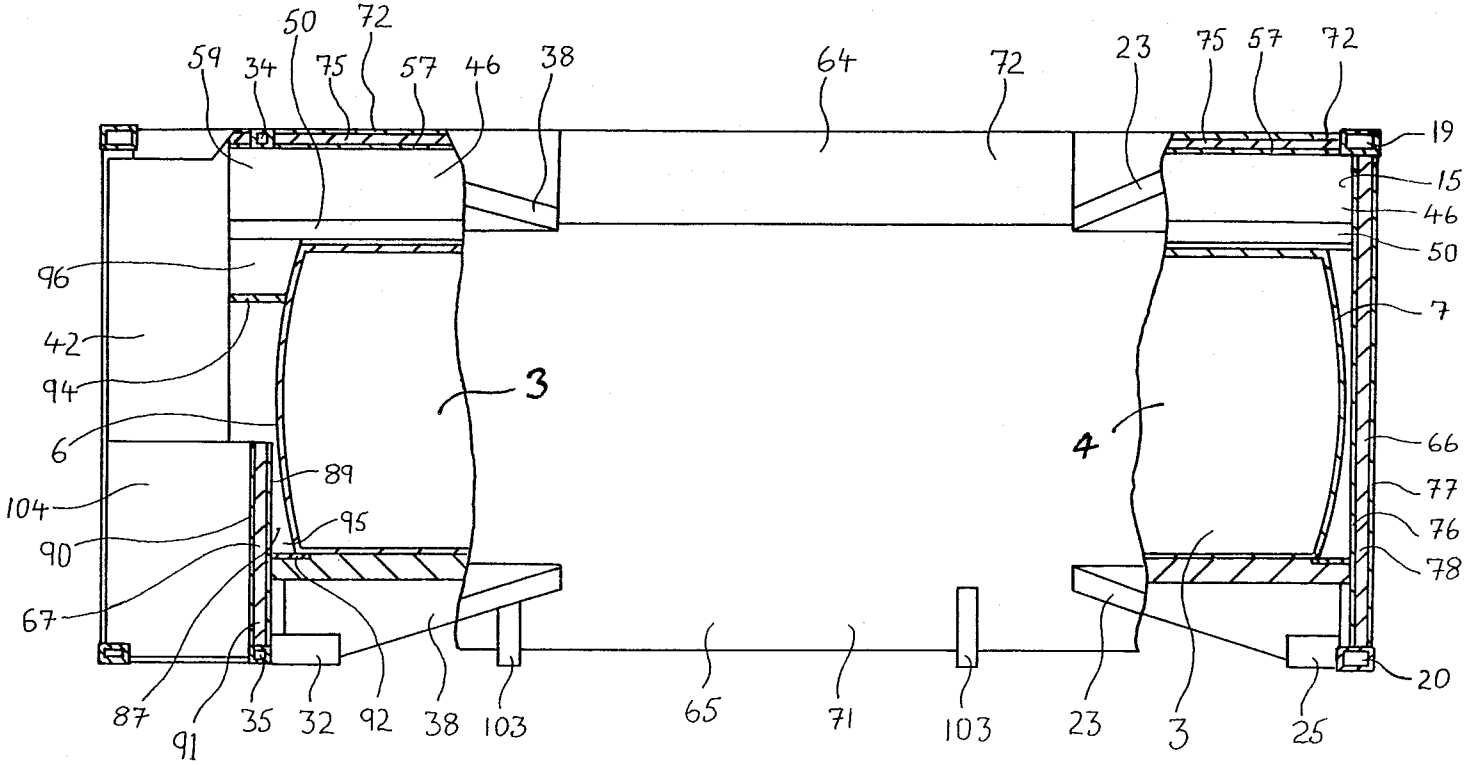
FIG. 9 is a sectional view of a detail of the tank container of FIG. 1 on the line IX–IX of FIG. 7.

A refrigerating unit 42 in this case a container reefer unit is mounted in the front end frame 14 for cooling a heat transfer medium, in this case air for circulating around the tank 3. A heat insulating shell 44 extends round the tank 3 and virtually completely encloses the tank 3. Flow ducts in this case provided by a pair of side ducts 45 on each side of the tank 3 carry chilled air in the direction of the arrows A for cooling the tank 3 from the refrigerating unit 42 along the sides of the tank 3, see FIG. 6. Return top ducts 46 return the chilled air to the refrigerating unit 42 in the direction of the arrows B. The ducts 45 and 46 are provided between the tank wall 5 and the insulating shell 44 and communicate with each other at the end of the tank 3 through a chamber 47 formed between the end cap 7 and the insulating shell 44. Arrows C illustrate how the chilled air flows from the side ducts 45 to the top ducts 46 over the end cap 7 of the tank 3, see FIG. 7. The side ducts 45 terminate in inlets 85 and the top ducts 46 terminate in outlets 86 at their other ends adjacent the front end cap 6 of the tank 3. As can be seen, the bearer members 23 and 38 extend through the insulating shell 44. Before describing the insulating shell 44 in detail, the construction of the side and top ducts 45 and 46 will first be described.

Each side duct 45 is formed by a plate member 49 extending the length of the tank 3 and joined to the tank 3 by side plates 50 welded to the tank 3. In this case, the plate member 49 and side plates 50 are integrally formed from sheet metal bent at 51. As can be seen, each plate member 49 is of arcuate shape and thus the side ducts 45 are of arcuate cross section. The centre of curvature of the plate members 49 co-incides with the longitudinal centre line 54 of the tank 3. The side ducts 45 are positioned on each side of the tank 3 in similar locations. In this particular case, a centre line 52 of each duct 45 substantially co-incides with the horizontal plane 53 of the tank 3 passing through the centre line 54, see FIG. 7. Further, the width of each side duct 45 between the side plates 50 is such that approximately 25% of the outer circumference of the transverse cross section of the tank 3 is covered by each side duct 45. In other words, referring to FIG. 7, the distance between the side plates 50 of each side duct 25 is substantially 25% of the outer circumference of the transverse cross section of the tank 3 and the side ducts 45 extend symmetrically about the horizontal plane 53.

Each top duct 46 is formed by a top plate 57 and side plates 58 and 59. The plates 57, 58 and 59 are integrally formed of sheet metal bent at 60. The side plate 58 is welded to the tank 3 at 61, while the side plate 59 is welded to the adjacent side plate 50 of the side duct 45 at 62. As can be seen, the top ducts are disposed on either side of a vertical plane 105 through the centre line 54 of the tank, and are equi-spaced therefrom, see FIG. 7. The top ducts 46 extend as can be seen for approximately 7% of the outer circumference of the transverse cross section of the tank.

The insulating shell 44 comprises a partly cylindrical portion 65 and a top portion 64 extending upwardly from the cylindrical portion 65. A rear end cap 66 and a front end cap 67 closes the insulating shell 44. The cylindrical portion 65 and top portion 64 are formed with an inner and outer skin and heat insulating material 75 retained between the inner and outer skins. The inner skin is formed by portions of the cylindrical tank wall 3 at 68 and 69 and by the plate members 49, 50, 57, 58 and 59 which form the side and top ducts respectively. The outer skin is formed by a partly cylindrical skin of sheet metal 71 and a top outer skin 72 also of sheet metal. The cylindrical sheet metal skin 71 is joined to the top sheet metal skin 72 by pop rivets 74 along the joints 73 and to the bearer members and top cross members 19 and 29 of the front and rear frames 14 and 15 also by pop rivets 74. In this case the insulating material 75 is expanded polyurethene which is poured in liquid form into the space between the inner and outer skins and allowed to set.

The end cap 66 is also formed by an inner and outer skin 76 and 77 respectively also of sheet metal with expanded polyurethene insulating material 78 retained between the skins 76 and 77. The sheet metal skins 76 and 77 are secured by pop rivets 79 to the rear end frame 15.

The plate members 49 and 50 forming the side ducts extend to the inner skin 76 of the end cap 66. Similarly, the plate members 57, 58 and 59 of the top ducts 46 also extend to the inner skin 76 of the end cap 66. Plate members 80 and 81 extending from the end cap 7 adjacent the portion 68 and 69 of the cylindrical wall 5 extend to the inner skin 76 of the end cap 66 to close off the end chamber 47. Thus, chilled air flowing through the side ducts 45 flows into the end chamber 47 over the end cap 7, where it is returned through the top return ducts 46. A discharge outlet 82 from the tank 3 with a valve 83 extends through the end wall 66 for discharging liquid from the tank 3.

Returning now to the front end frame 14, the inlets 85 to the side ducts 45 and outlets 86 of the top ducts terminate in a front end chamber 87 formed between the front end cap 6, the refrigerating unit 42 and a front end cap 67 of the insulating shell 44. The end cap 67 comprises an inner and an outer skin 89 and 90 respectively retaining expanded polyurethene insulating material 91 therebetween. The inner and outer skins 89 and 90 are secured by pop rivets to the inner frame 26 of the front end frame 14 in similar fashion as the end cap 66 is secured to the rear end frame 15. The lower portion of the chamber 87 is defined by a plate member 92 extending from the tank 3 at 68 to the inner skin 89 of the end cap 67. The plate members 49 of the side ducts 45 extends to the inner skin 89. The plate members 49 and the plate members 57, 58 and 59 of the top ducts 46 extend forwardly to sealably engage the refrigerating unit 42. A plate 88 extends to the refrigerating unit from the top portion 69 of the tank 3 to close the top of the chamber 87. A partition 94 formed of sheet metal extending from the front end cap 6 divides the chamber 87 into flow and return chambers 95 and 96 respectively. Thus, air returning through the top ducts 46 is delivered into the return chamber 96, where it is in turn delivered into an inlet (not shown) of the refrigerating unit 42. Air delivered from an outlet (not shown) of the refrigerating unit 42 is delivered into the flow chamber 95 where it is in turn delivered into the side ducts 45.

A control panel 97 is provided on the refrigerating unit 42 for controlling the refrigerating unit 42 and in turn the temperature of the contents of the tank 3. A gauge 98 displays the operating temperature of the refrigerating unit 42. An inlet grill 99 is provided in the refrigerating unit 42 for the intake of make-up air.

A fan (not shown) is mounted in the refrigerating unit to circulate the air through the ducts 45 and 46. Control circuitry (not shown) for the refrigerating unit 42 is provided in a housing 104 mounted in the front frame 14.

A manhole inlet 100 closed by a cover 101 is provided to the tank 3. Such inlets will be well known to those skilled in the art. Other suitable inlets (not shown) are also provided to the tank 3. Chocks 103 of bent metal plate material extend through the insulating shell 44 and are welded to the tank 3.

Suitable temperature sensing probes (not shown) are provided at appropriate locations in the side ducts 45 and top ducts 46 to monitor the temperature of the flow and return air. The probes are connected to appropriate control circuitry (not shown) of the refrigerating unit 42. If desired, probes may also be provided in the tank 3 to monitor the temperature of the contents of the tank 3 which would also be connected to the refrigerating unit 42.

Figure 12:
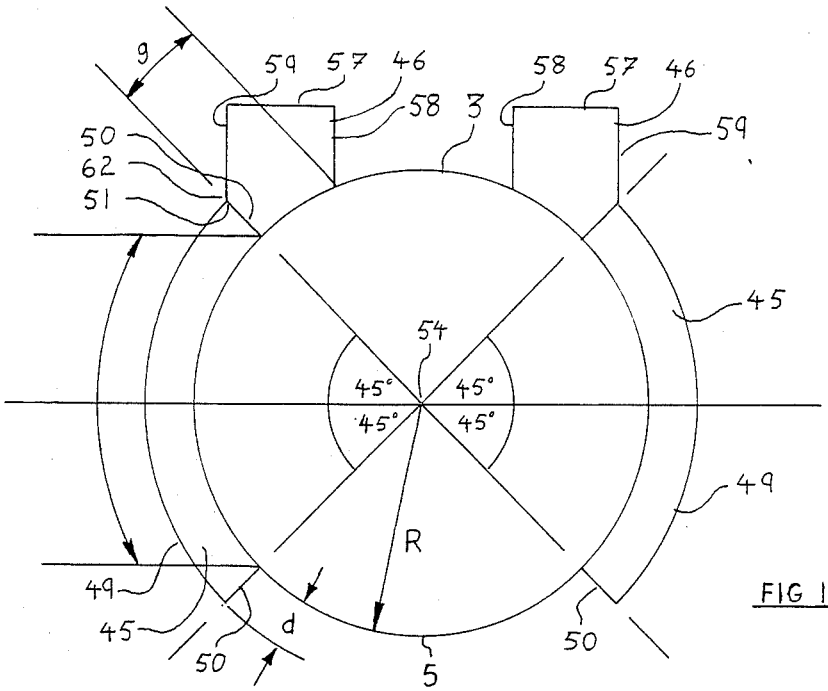
FIG. 12 is a diagrammatic sectional view of portion of the tank container of FIG. 1.

In this particular embodiment of the invention, the outer radius of the tank 3 is 1,100 mm. A diagrammatic representation of the tank 3 with the side ducts 45 and top ducts 46 is illustrated in FIG. 12. The side ducts 45 extend around the outer surface of the tank 5 so that each side duct forms with the longitudinal axis 54 of the tank 3 an included angle of 90°. Thus, each side duct 45 covers approximately 25% of the outer circumference of the transverse cross section of the tank 5. In this case, the width of the side ducts between the plates 50 along the outer circumference of the tank, namely the distance e is 1,725 mm. The depth d, namely the distance from the plate 49 to the tank wall 5 is 50 mm. Each top duct 46 extends along the outer circumference of the tank 5 a distance g, which in this case is 500 mm. Thus, each top duct 46 covers approximately 7% of the outer circumference of the transverse cross section of the tank 5. The depth of the stiffening hoops 9 is less than the depth of the side ducts 45 to facilitate the flow of chilled air through the ducts 45. The dimensions given here are in respect of one specific embodiment of the invention. They do not in any way limit the scope of the invention, and it will be readily apparent to those skilled in the art that tank containers of other shape, construction and dimensions could be provided without departing from the scope of the invention.

The tank container is constructed as follows. The tank 3 and front and rear end frames 14 and 15 are separately constructed. The tank 3 is then mounted to the end frames 14 and 15 by the bearer members 23 and 38. The plate members 49 and 50 forming the side ducts are then welded to the tank 3, as are the plate members 57, 58 and 59 to form the top ducts 46. The plate members 80, 81, 88, 92 and 94 are also secured to the tank. The sheet metal inner and outer skins of the insulating shell 44 are provided around the tank and are appropriately secured by the pop rivets to the frames 14 and 15 and bearer members 23 and 28. Openings (not shown) are left in the outer skin at appropriate locations, and polyurethene in liquid form is pumped between the inner and outer skins of the insulating shell 44 through these openings (not shown) until the entire volume between the inner and outer skins is filled with expanded polyurethene. The openings are then closed off by sheet metal patches pop riveted to the outer skin. The refrigerating unit is mounted in the front frame 14 and the tank is ready for use.

In use, the controls 97 of the refrigerating unit 42 are set to the desired temperature at which the contents of the tank 3 are to be retained. The refrigerating unit 42 is then activated. Chilled air is delivered from the refrigerating unit to flow through the side ducts 45 and into the chamber 47 around the end cap 7 of the tank 3. The chilled air returns through the top ducts 46 where it is delivered into the refrigerating unit for rechilling and recirculation.

While the insulating shell has been described as being of particular shape, size and construction, it could be of any other desired shape or construction. The outer skin of the insulating shell could be of any other material besides sheet metal, and indeed, in certain cases, it is envisaged that it may be fibreglass or any other suitable plastics material. Similarly, the plate members 49 and 50 and 57, 58 and 59 of the side and top ducts 45 and 46 respectively may be of any other material besides sheet metal. For example, they may also be of fibreglass material or any other plastics material as desired. Needless to say, any other suitable insulating material could be used besides expanded polyurethene. Indeed, in certain cases, it is envisaged that a powder or granular insulating material could be used without departing from the scope of the invention. Needless to say, any other suitable insulating material or medium could be used. Indeed, where the insulating material is a self supporting material, in certain cases the outer skin may be dispensed with as could some or all of the plate members which form the ducts 45 and 46. In which cases, the ducts would be formed merely by the tank wall and insulating shell. In other cases, it is envisaged that the outer skin may be used as a mould to form the insulating shell and then dispensed with.

While the tank container has been described as having two return top ducts, in certain cases it is envisaged that a single top duct may be provided, and indeed, in certain cases more than two top ducts could be provided.

While the top ducts and side ducts have been described as being separated by the adjacent plate member 50, any other suitable means to separate the top and side ducts could be used. For example, in certain cases, it is envisaged that the insulating material may abut the cylindrical wall of the tank between the top and side ducts.

It will be appreciated that in all cases it will not be necessary for each side duct to cover approximately 25% of the outer circumference of the transverse cross section of the tank. In certain cases, it is envisaged that each side duct will only cover 10% of the tank, in which case, it is envisaged that adequate chilling would be achieved. However, it is believed that better results are achieved when each side duct covers at least 15% of the circumference of the transverse cross section of the tank. Needless to say, it will be appreciated that if desired the side ducts could cover more than 25% of the outer circumference of the transverse cross section of the tank.

It is envisaged that while each top duct covers approximately 7% of the outer circumference of the transverse cross section of the tank, adequate results would be achieved if each top duct covered as low as 2% of the outer circumference of the transverse cross section of the tank. However, it is believed that better results are achieved when each top duct covers at least 5% of the outer circumference of the transverse cross section of the tank. Needless to say, the top ducts could cover more than 7% of the outer circumference of the transverse cross section of the tank.

Indeed, in certain cases, it is envisaged that one or more ducts could be provided extending longitudinally along the lower portion of the tank between the two side ducts. These ducts may either carry the heat transfer medium in the flow direction or the return direction. Further, it is envisaged that further ducts extending longitudinally of the tank could be provided between the two top ducts. These ducts could carry the heat transfer medium either in the flow or return direction.

Further, it will be appreciated that while the tank container has been described as comprising a cylindrical tank, a tank of any shape or construction could be provided, for example, a tank of square or rectangular section or any other cross section, for example, hexagonal, octagonal or the like. It will also be appreciated that end frames other than those described could be provided. Indeed, in certain cases, it is envisaged that the end frames may be joined by longitudinally extending members which would extend between the upstanding members and/or top and bottom cross members, and/or corner castings. Additionally, it is envisaged in certain cases that longitudinal strengthening ribs may be provided on the tank, and these may extend, if desired between the bearer members. In fact, in certain cases, it is envisaged that the bearer members may be mounted on the strengthening ribs. It is also envisaged that heat exchanging plates may be provided in the top and side ducts, for example, it is envisaged that a plurality of longitudinal plate members or otherwise directed plate members may extend from the tank wall into the top and side ducts to further facilitate heat exchange between the tank and cooling medium. It will also be appreciated in certain cases that the heat exchanging plates may extend between the tank wall and the plate members 49 and 57 of the side and top ducts respectively.

Needless to say, any other suitable refrigerating unit could be used besides that described. Indeed, in certain cases, it is envisaged that the tank may be provided without a refrigerating unit, and the tank would thus be suitable for connecting into an independent refrigerating system, such as, for example, a refrigerating system provided on board a ship, or a refrigerating system provided on a truck or rail car or the like. In which case, approximately constructed inlets and outlets would be provided to the side ducts 45 and top ducts 46, or in the end cap of the insulating shell adjacent the front end frame for connecting to such an independent refrigerating system.

Furthermore, it will be appreciated that a front end frame of any other shape or construction could be provided. Indeed, where a different refrigerating unit of a different shape or construction is provided, it is envisaged that a frame of appropriate shape and construction would be used to house the refrigerating unit.

It is also envisaged that where the tank container is provided without an inbuilt refrigerating unit, the front end frame could be constructed similarly to the rear end frame, and in which case, a single inlet and outlet would be provided for the cooling medium. This inlet and outlet would be connected to the side and top ducts 45 and 46 respectively.

Needless to say, side and top ducts of other shape and construction could be provided without departing from the scope of the invention.

Furthermore, while the end frames have been described as being constructed to ISO standard and that the entire tank container has been constructed to ISO standards, it could be constructed to any other standards. Indeed, it is envisaged that the tank container could be constructed so that it would be suitable for mounting on a swap body truck.

It is also envisaged that while the tank container has been described as comprising a chamber for the chilled air in front and end thereof, the chambers, in certain cases, may be dispensed with. Needless to say, while the tank has been described as comprising dished ends which are of convex construction, in certain cases, it is envisaged that the tank may be provided with dished ends which would be of concave construction or in certain cases flat ends.

Needless to say, it will be appreciated that while it may be preferable for the insulating shell to be substantially cylindrical or in the case of a tank of other construction to substantially follow the cross sectional profile of the tank, this is not necessary. The outer shell could be of any other shape or construction or any other cross section, for example, rectangular cross section, square cross section, hexagonal cross section.

Needless to say, while air has been described as being the heat transfer medium, any other suitable heat transfer medium could be provided, for example, a liquid heat transfer medium could be used such as water or any other gas.

It will also of course be appreciated that the heat transfer medium could be circulated in the reverse direction, for example, the heat transfer means could be arranged to flow along the top ducts and return along the side ducts. Needless to say, while the tank container has been described as being a refrigerated insulated tank container, it could be provided as a heated insulated tank container, in which case, the heat transfer medium would be heated instead of cooled, and the heat transfer medium could be heated by a suitable heating means mounted on the tank container, for example in place of the refrigerating unit. Alternatively, the tank container could be connected to an independent heating system for heating the heat transfer medium.

I claim:

1. A temperature controllable tank container comprising:

a pair of end frames, a tank mounted between the end frames, an insulating shell extending round the tank and substantially enclosing the tank, and abutting the tank along a lower portion of the tank, two elongated side ducts for carrying a heat transfer medium in one direction along the tank being provided between the insulating shell and the tank, and disposed longitudinally relative to the tank, one of the side ducts being provided on one side of the tank and the other side duct being provided on the opposite side of the tank, the side ducts being provided in substantially similar locations on their respective sides of the tank and being separated by the portion of the insulating shell abutting the lower portion of the tank, at least one other duct extending longitudinally along the tank between the insulating shell and the tank for carrying the heat transfer medium in the other direction, communicating means at one end of the tank to communicate the side ducts with the other duct, and inlet and outlet means being provided to respective ducts at the other end of the tank for connecting the ducts to a heating or cooling means.

2. A tank container as claimed in claim 1 in which the other duct for carrying the heat transfer medium in the other direction is provided by at least one longitudinally disposed, elongated top duct extending along the top of the tank.

3. A tank container as claimed in claim 1 in which the side ducts are arranged so that a longitudinal centre line of each duct co-incides with a horizontal plane of the tank which extends through a longitudinal centre line of the tank.

4. A tank container as claimed in claim 1 in which each side duct extends over at least 10% of the outer circumference of the transverse cross section of the tank.

5. A tank container as claimed in claim 4 in which each side duct extends over 25% of the outer circumference of the transverse cross section of the tank.

6. A tank container as claimed in claim 1 in which each side duct is of arcuate cross section.

7. A tank container as claimed in claim 2 in which a pair of top ducts are provided, the top ducts being equispaced on either side of a central longitudinal vertical plane of the tank.

8. A tank container as claimed in claim 7 in which each top duct extends over at least 2% of the outer circumference of the transverse cross section of the tank.

9. A tank container as claimed in claim 1 in which the tank is of cylindrical construction having an elongated cylindrical portion closed by end caps, the insulating shell being of partly cylindrical construction and extends around the tank and abuts portions of the tank, a top portion of the insulating shell extends upwardly to form each top duct.

10. A tank container as claimed in claim 9 in which the insulating shell comprises a heat insulating material disposed between an outer skin formed of sheet material and an inner skin formed by portion of the tank wall and plate members which form the ducts.

11. A tank container as claimed in claim 10 in which the heat insulating material is expanded polyurethene material.

12. A tank container as claimed in claim 1 in which the insulating shell is closed at one end by an end cap spaced apart from the end cap of the tank to form the communicating means, the end cap being of a heat insulating material.

13. A tank container as claimed in claim 1 in which bearer members extending from each end frame to the tank through the insulating shell support the tank.

14. A tank container as claimed in claim 1 in which a cooling means provided by a refrigerating unit to cool the heat transfer medium is mounted in the end frame adjacent the inlet and outlet of the ducts, the refrigerating unit being connected to the inlet and outlet for circulation of the heat transfer medium through the side and top ducts, means to circulate the heat transfer medium being provided.

15. A tank container as claimed in claim 14 in which the heat transfer medium is delivered from the refrigerating unit to the side ducts and returned to the refrigerating unit through each top duct.

16. A tank container as claimed in claim 14 in which the end frame within which the refrigerating unit is mounted comprises an outer and an inner framework, the refrigerating unit being mounted between the inner framework and the outer framework.

17. A tank container as claimed in claim 1 in which the end frames are constructed to ISO standards.

18. A tank container as claimed in claim 1 in which the cooling medium is air.

* * * * *